US005727824A

United States Patent [19]

Smith et al.

[11] Patent Number: 5,727,824

[45] Date of Patent: Mar. 17, 1998

[54] ISOLATIVE COUPLING FOR A THUMB-LEVER UNIT OF A DOOR LOCKSET

[75] Inventors: William D. Smith, Fair Oaks; Bella Rubin, San Francisco; Beat Heri, Moraga, all of Calif.

[73] Assignee: Schlage Lock Company, San Francisco, Calif.

[21] Appl. No.: 694,147

[22] Filed: Aug. 8, 1996

[51] Int. Cl.[6] ..... E05B 3/00

[52] U.S. Cl. ..... 292/336.3; 292/169.21; 292/DIG. 62

[58] Field of Search ..... 292/336.3, 165, 292/169.21, DIG. 62, 356

[56] References Cited

U.S. PATENT DOCUMENTS 2,485,054 10/1949 Lickteig ..... 292/165

3,287,054 11/1966 Russell et al. ..... 292/336.3

5,286,074 2/1994 Lin ..... 292/336.3

*Primary Examiner*—Rodney M. Lindsey

*Attorney, Agent, or Firm*—Robert F. Palermo; Michael H. Minns

[57] ABSTRACT

A door lockset, mounted on a door having an inside and outside face, has a latch bolt operated by a lever handle from the inside and by a grip handle thumb lever from the outside, the latch bolt being biased to an extended position except when retracted by operation of the handles, the inside lever handle being mounted in a parked position on a spindle connected to a lever return mechanism and having a latch operator attached thereto. An improvement in combination with the lockset, provides a mechanism for operating the latch bolt by the thumb lever without moving the inside lever from the parked position.

4 Claims, 2 Drawing Sheets

ISOLATIVE COUPLING FOR A THUMB-LEVER UNIT OF A DOOR LOCKSET

BACKGROUND OF THE INVENTION

This invention relates generally to door locksets having outside grip handles with thumb-levers and inside lever handles and more particularly to locksets having an isolative coupling for simplifying handing of the handles during installation and operation of the handles in service.

Doors with locksets having grip handles and thumb levers on the outside and knobs or lever handles on the inside are commonly used in both residential and commercial buildings. In cases where knobs are used, only a light knob return spring, if any, is needed to return the knob to its "parked" position. In most cases, the latch bolt extension spring alone is sufficient to serve also as a knob return. The Americans with Disabilities Act (ADA), however, has led to increased use of inside levers to accommodate persons with limited manual strength and dexterity. Such levers make it easier to retract the latch bolt; because they at least triple the mechanical advantage afforded by knobs. However, since levers are inherently out of balance about the spindle axis, and since they are also much heavier than door knobs in order to endure the added stresses created by their large mechanical advantage, the return springs needed to return the levers to their horizontal "parked" position without any sagging must be proportionally larger and stiffer. This is not a problem if levers are used on both the inside and outside of the door, since, in such cases both inside and outside levers have equal mechanical advantage; however, when a thumb-lever grip handle is used on the outside of the door, the low mechanical advantage of the thumb lever makes it very difficult to operate the latch bolt and to overcome the force of the handle return springs. For children or persons having limited manual strength and dexterity, it may not be possible to operate a door lock with such a configuration.

The foregoing illustrates limitations known to exist in present locksets using grip handle thumb levers on the outside and lever handles inside. Thus, it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this advantage is achieved by providing in a door lockset, mounted on a door having an inside and outside face, the lockset having a latch bolt operated by a lever handle from the inside and by a grip handle thumb lever from the outside, the latch bolt being biased to an extended position except when retracted by operation of the handles, the inside lever handle being mounted in a parked position on a spindle connected to a lever return mechanism and having a latch operator attached thereto, the improvement, in combination with the lockset, comprising a mechanism for operating the latch bolt by the thumb lever without moving the inside lever from the parked position.

The foregoing and other aspects will become apparent from the following detailed description of the invention when considered in conjunction with the accompanying drawings.

DETAILED DESCRIPTION

Figure 1:
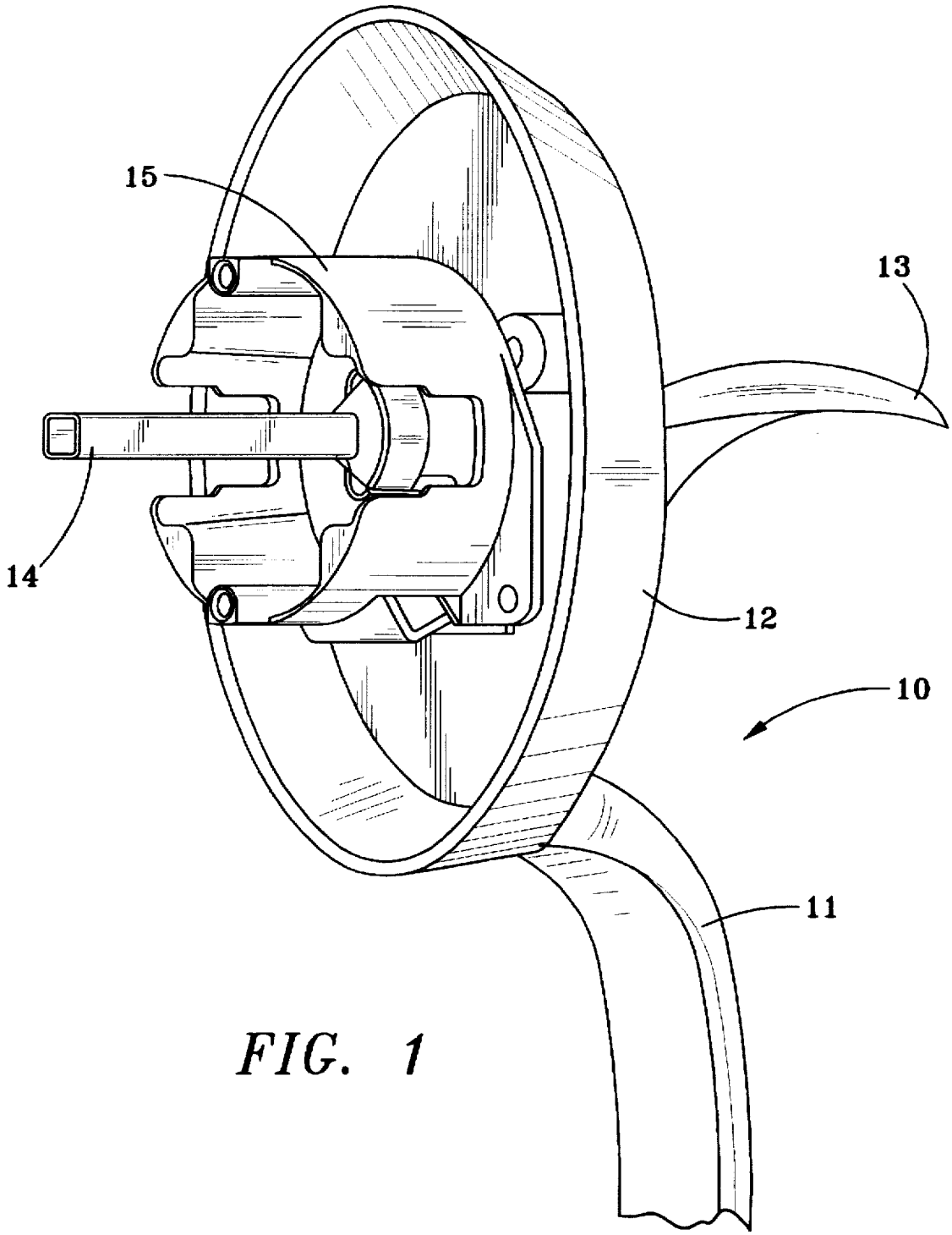
FIG. 1 is a fragmentary schematic perspective view, from the door side, of a typical grip handle thumb lever unit of the current art.

FIG. 1 shows some detail of the structure of a typical thumb lever grip handle assembly 10 currently in use in locksets installed on doors. It consists of the grip handle 11, the rose, or mechanism cover or escutcheon 12, which is often formed as a single piece with the door grip handle 11, and the thumb piece or thumb lever 13. The thumb lever 13 extends through the wall of escutcheon 12 to an axis (not visible) about which it pivots, and ends as a lift cam 17 which pushes against the cam follower 16 on the outboard end of spindle 14 to operate the latch (not shown). The thumb lever 13 has a light spring to lift it when released, but the spindle 14 is returned to the parked position by the latch bolt extension spring and/or other springs in the lockset.

Figure 2:
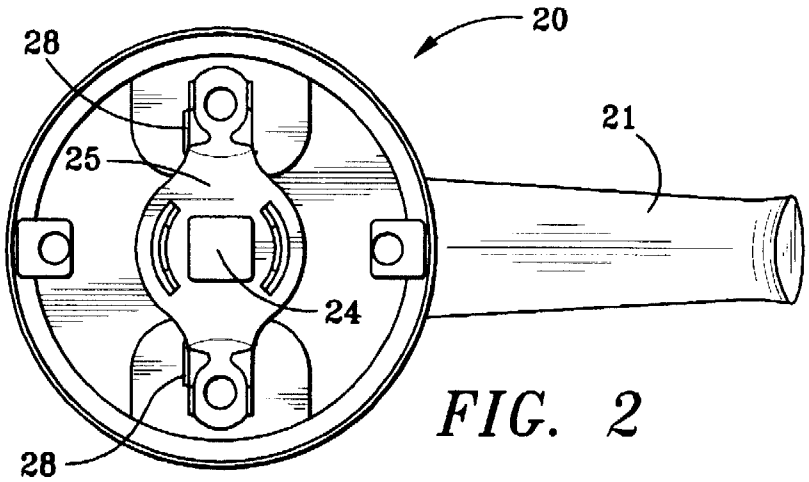
FIG. 2 is a schematic elevation view, from the door side, of a lever handle and mounting plate of the current art.

The lever handle of the current art, shown in FIG. 2, has lever return springs 28 which act upon spring cage 25 and, through the rectangular drive socket 24, upon spindle 14 to return it to the parked position. The lever 21 is attached to the spring cage 25 by spindle tabs 27 which protrude through arcuate slots in the spring cage and are staked or otherwise secured to the spring cage. Thus, whenever the lever 21 is moved, the spring cage 25 must follow and vice versa. Any rotation of the spring cage 25 is against the bias produced by the lever return spring 28. The unbalanced weight of the lever handle 21 requires a strong return spring 28 in order to properly support the lever handle without objectionable sag. Thus, when a thumb lever 13 of the present art is depressed to retract the latch, the spindle 14, at the same time as it is retracting the latch bolt (not shown), must overcome the lever return spring 28. This is a rather difficult task since the thumb lever 13 has a very small mechanical advantage compared to that of the lever handle 21.

Figure 3B:
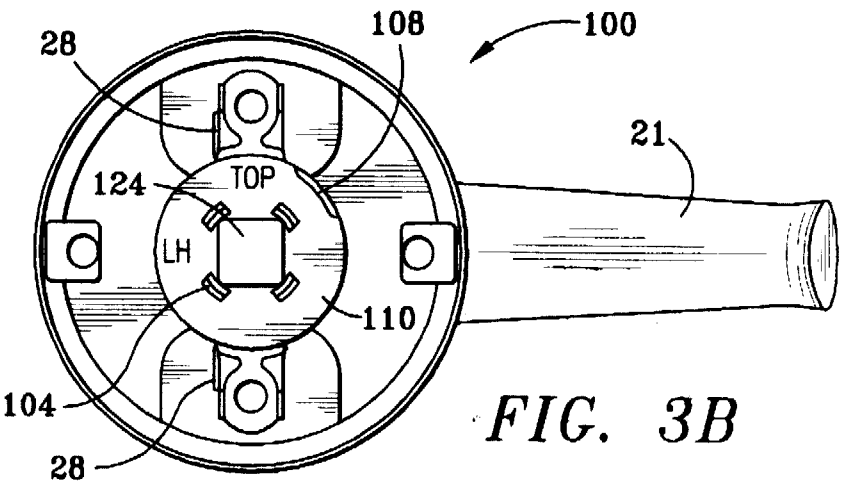
FIGS. 3*a* and 3*b* are schematic elevation views, as in FIG. 2, of a lever handle adapted for incorporating the coupling, and with the coupling installed, respectively.
Figure 3A:
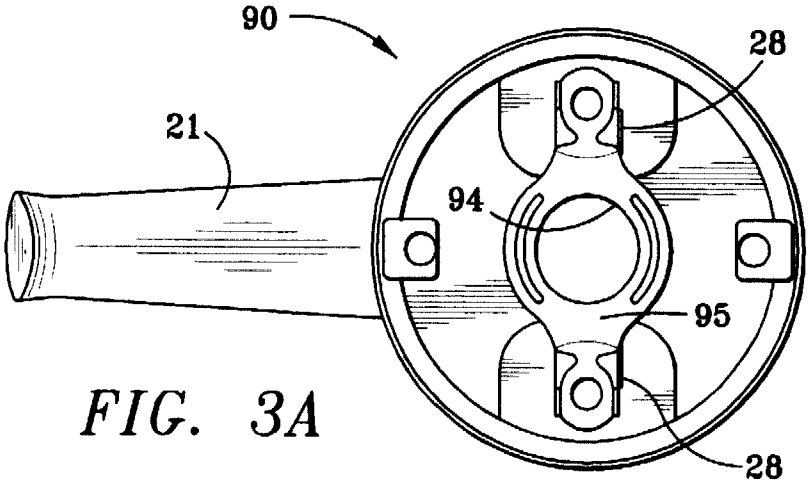

The lever assemblies shown in FIGS. 3*a* and 3*b* reveal details of the invention. To provide the drive isolation desired, the spring cage 95 is modified to have a round opening 94 in place of the rectangular drive socket 24 of FIG. 2. Lever spindle tabs are still secured in the spring cage 95, so that the lever return springs 28 still provide the return action for the lever. However, round opening 94 does not engage the rectangular drive spindle 14 (FIG. 1) in any driving or driven relationship. One object of the invention, namely, isolation of the lever handle 21 and its return springs 28 from the drive spindle 14 of the thumb lever 13, has thus been accomplished.

Figure 4B:
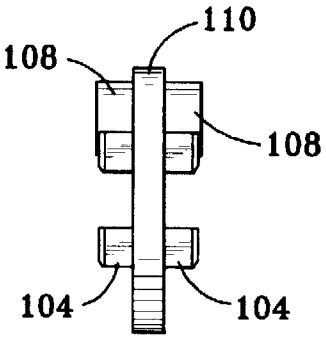
FIGS. 4*a* and 4*b* are front and side elevation views, respectively, of the isolative coupling of the invention.
Figure 4A:
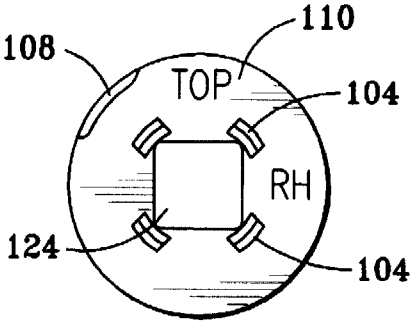

Since it is still desired to operate the latch bolt from both the thumb lever 13 and the lever handle 21, the isolative coupling 110 in FIG. 4*a* is added to the assembly of FIG. 3*a*. By considering FIGS. 3*b*, 4*a*, and 4*b*, the structure and function of the coupling 110 can best be understood. The coupling 110 has a number (four shown, for example) of "barbed" tabs 104 extending axially adjacent the rectangular drive socket 124. These tabs 104 are spaced such that they provide a snap fit in the round hole 94 in the spring cage 95, thereby axially securing the coupling 110 to the spring cage 95 while still permitting the coupling 110 to rotate with respect to the spring cage 95. A drive lug 108 projects axially from the edge of the coupling 110 and subtends a sufficient arc on its circumference to provide a limited amount of lost motion between the spring cage 95 and the coupling 110. This lost motion allows retraction of the latch bolt with the thumb lever 13 while only overcoming the latch bolt extension spring and the thumb lever support spring, if any. The drive spindle 14 can operate without any connection to the lever return spring 28 when operated by the thumb lever 13. The lever handle 21, on the other hand, will operate the drive spindle 14 and the latch bolt by means of the drive lug 108 on the coupling 110 which is driven clockwise as viewed in FIG. 3*b* by the spring cage 95. When the lever handle 21 is released, the spring cage 95 and lever handle 21 are returned to the parked position by the lever return spring 28, but because of the round hole 94, the coupling 110 is not driven to follow the spring cage 28. Rather, the coupling 110 and spindle 14 are returned to the parked position by the latch bolt extension spring which is part of the latch bolt assembly (not shown).

The isolative coupling 110 is shown in FIGS. 4*a* and 4*b*. FIG. 4*a* shows the right handed version of the coupling, as compared to the left handed version seen in FIG. 3*b*. Note that, as seen in FIG. 4*b*, the coupling 110 is axially symmetric, and the opposite faces are mirror images of each other so that the top edges of the drive lugs 108 are at 1 o'clock and 11 o'clock, when viewed from the door side, for left hand and right hand installations, respectively. The coupling 110 is preferably made as a two-sided reversible piece which can be used with doors of either handing by merely turning the coupling around, but it could also be made as a single-sided single-handed piece.

In use, the isolative coupling 110 permits retraction of a latch bolt using a thumb lever 13, without having to overcome the bias of the lever return springs 28; because the spring cage 95 has a round hole 94 which has no driving connection to the coupling 110. Depending upon the handing of the installation, the lever handles 21 will drive the isolative couplings 110 either counterclockwise or clockwise, respectively, as viewed in FIGS. 3*a* and 3*b*.

Having described the invention, we claim:

1. A coupling, for use with a door lockset mounted on a door having an inside and outside face, said lockset having a latch bolt operated by a lever handle on the inside face and by a thumb lever of a grip handle on the outside face, said latch bolt being biased to an extended position except when retracted by operation of said handle and thumb lever, said inside lever handle being mounted in a parked position on a spindle engaged with said latch bolt, said latch bolt being operated between said extended position and said retracted position by said spindle, the coupling comprising:

means for operating said latch bolt by said thumb lever without moving said inside lever from said parked position, the means for operating said bolt by said thumb lever without moving said inside lever from said parked position comprising an isolative member for being drivably connected to said spindle operated by said thumb lever; and means for operating said latch bolt by rotating said inside lever handle, the means for operating said latch bolt by rotating said inside lever handle comprising a lever return mechanism for connection to said lever handle having a latch operator and a circular hole in said latch operator; said isolative member being rotatably mounted in said circular hole and having a first drive lug, to provide limited lost motion with said latch operator, for projecting axially outwardly toward said lever for drivable engagement with said latch operator; and having a centered drive socket means for drivable engagement with said latch operator spindle.

2. The coupling of claim 1, wherein said isolative member further comprises: a second drive lug projecting axially inwardly to mirror an opposite surface of said isolative coupling and to thereby provide reversibility of handing of the lockset.

3. In a door lockset having a thumb lever grip handle for mounting on an outside face of a door and a lever handle for mounting on an inside face of the door, said thumb lever being drivably engaged with a drive spindle for retracting a latch bolt, and said lever handle being connected to a spring cage having a lever return spring, a round hole in the center of said spring cage for receiving said drive spindle;

an isolative member having a drive socket for engaging said drive spindle, a plurality of tabs for rotatably gripping said round hole of said spring cage, and an axially protruding driving lug means for engaging said spring cage; said isolative member providing means for operating said latch bolt by said thumb lever without engagement of said lever return spring but still permitting operation of said latch bolt by said lever handle.

4. An isolative coupling for a door lockset having an outside thumb lever grip handle and an inside lever handle for operating a latch bolt, comprising:

a substantially circular disk having a drive spindle drive socket and means for rotatably gripping a spring cage attached to an inboard end of said lever handle and a drive lug for engaging said spring cage when said spring cage rotates with said lever handle, said drive lug allowing said disk to rotate independently of said spring cage to a sufficient degree to operate said latch bolt without moving said spring cage and said lever handle.

* * * * *